United States Patent [19]

Collins

[11] 4,190,165

[45] Feb. 26, 1980

[54] PIPE CHOCK STICK

[75] Inventor: Edward H. Collins, Medford, Oreg.

[73] Assignee: The Mt. Pitt Company, Medford, Oreg.

[21] Appl. No.: 864,216

[22] Filed: Dec. 27, 1977

[51] Int. Cl.[2] ..... B65G 1/14

[52] U.S. Cl. ..... 211/60 R; 211/49 S

[58] Field of Search ..... 211/60 R, 60 S, 49 S, 211/49 R, 194, 13; 214/10.5 R, ; 248/119 R; 403/347

[56] References Cited

U.S. PATENT DOCUMENTS

| | | | |
|---|---|---|---|
| 770,510 | 9/1904 | Stullken | 248/119 R X |
| 833,454 | 10/1906 | Flemming | 248/119 R X |
| 2,097,172 | 10/1937 | Yurkovitch | 403/347 X |
| 2,149,589 | 3/1939 | Duaei | 211/60 R |
| 2,611,495 | 9/1952 | Weaver | 214/10.5 R |
| 3,091,348 | 5/1963 | Neuhauser | 211/49 S X |
| 3,581,907 | 6/1971 | Schmidt | 211/60 R X |
| 3,658,195 | 4/1972 | Fantin | 214/10.5 R |

*Primary Examiner*—Roy D. Frazier
*Assistant Examiner*—Robert W. Gibson, Jr.
*Attorney, Agent, or Firm*—Kolisch, Hartwell, Dickinson & Stuart

[57] ABSTRACT

A pipe chock stick used in stacking pipes. The chock stick comprises a longitudinal board having end slots, and one-way and two-way notch blocks slidably received and lockable within the slots.

2 Claims, 9 Drawing Figures

PIPE CHOCK STICK

BACKGROUND AND SUMMARY

The following invention relates to chocks and in particular to chock sticks used in stacking pipes or the like in a multi-tier configuration.

In the past, pipes or tubes have been unitized using wedge-block chock sticks. Such chock sticks generally include an elongate stacking board having triangular wedge blocks nailed near each end of the board.

In using such a pipe stick a wedge block is nailed to one or both sides of the board at one end board before placing that board on the stacked pile. Then, after a row of pipes is stacked on that board a second wedge block is placed at one or both sides of the board the other end of the board, firmly against the end pipe, and nailed into the board.

For a number of reasons, the above-described chock stick has not been entirely satisfactory. First, in at least one of the two end blocks, the nail must be driven inwardly against the outwardly-directed force of the pipes. As a result, the force of the pipes tends to work the inwardly nailed wedge block out of the board. This problem is aggravated when such pipes are being transported and constant pipe shifting is acting against the two wedge blocks.

Secondly, chock sticks of the above-described type tend to split when a nail is driven through the blocks, or when the nailed blocks are subjected to periodic pipe shifting during transport. Customarily, the wedge blocks are not reusable because repeated nailing and removal of the nail increases the chance of such splitting.

Thirdly, it is often desirable to affix supporting blocks to both top and bottom sides of the chock board. With the above-described chock sticks, nailing a wedge block to the lower side of a stack board is awkward, and further, may result in splitting of the board end by driving nails thereinto from opposing directions.

It is an object of the present invention to provide a pipe chock for stacking pipes of the like which overcomes the above-described shortcomings of prior art pipe chock sticks.

More particularly, it is an object of the invention to provide a pipe chock stick in which the end blocks are secured to the longitudinal board by nails engaging the board and blocks transversely.

It is a further object of the present invention to provide such a chock stick having board and block pieces which may be repeatedly assembled and disassembled without substantially weakening the board or block pieces.

It is another object of the present invention to provide a chock stick in which each end piece provides end support at the top and bottom surfaces of the chock board.

It is yet another object of the present invention to provide such a chock stick in which the board may be assembled with a variety of different end blocks, depending on the desired use.

To this end the present invention comprises a longitudinal board having end slots and one-way and two-way notch blocks slideably received within the end slots. The notch blocks are locked in the board slots at preselected positions by driving a nail or other suitable fastener into the board against a lateral surface of the block.

Because the securing nails engage the block laterally, at right angles to the line of force of the pipes, the tendency of the pipes to work the notch blocks loose is greatly minimized. As a further advantage, the nails may be easily removed after use without danger of splitting the blocks.

The notch blocks are so constructed that the sides of the blocks are firmly held between the sides of the board slots and bracing arm portions of the blocks engage the upper and lower end faces of the board. This partial interlock between the notch blocks and the board ends serves to transfer part of the force applied to the block to the board faces thus reducing the force applied directly to the securing nail.

The interlocking construction of the present invention may be adapted to accommodate a variety of board sizes, slot widths, and block thicknesses, depending on the weight of the pipes supported and the degree of horizontal support desired.

The following objects and features of the present invention will now be described more fully with reference to the following detailed description of the invention and the accompanying drawings.

DETAILED DESCRIPTION OF THE INVENTION

Figure 1:
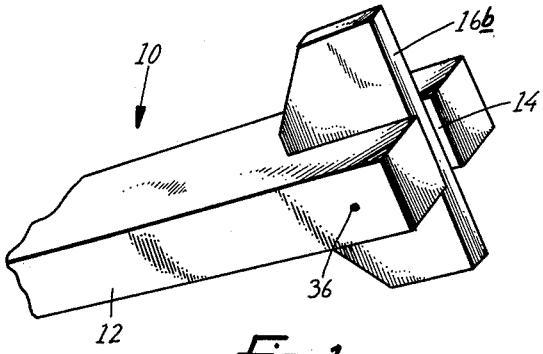
FIG. 1 is a perspective view of an end portion of the chock stick of the present invention.

Referring now to FIG. 1, there is shown an end section of the pipe chock stick 10 of the present invention. The pipe chock comprises a longitudinal board 12, shown fragmentarily, having an end slot 14 at each end. Engageable within each end slot is a notch block 16*a* or 16*b* which interlocks with the board 12 to form a vertically-extending brace, or brace means at each board end.

Figure 2A:
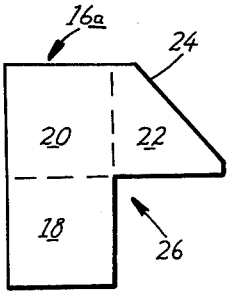
FIGS. 2*a* and 2*b* show in side view a one-way and two-way notch block, respectively, employed in the present invention.
Figure 5:
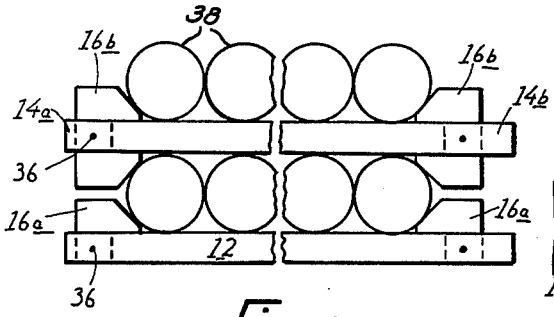
FIG. 5 is a foreshortened side view showing the stacking of two tiers of pipes using the pipe chock sticks of the present invention.

The notch blocks of this invention are of two types. The one-way block 16*a* illustrated in FIG. 2*a*, is designed for use with the lowermost board in a pipe stacking configuration, as shown in FIG. 5. The two-way block 16*b* shown in FIG. 2*b*, is used in combination with boards stacked above the first tier in a pipe stacking configuration (FIG. 5).

Figure 2B:
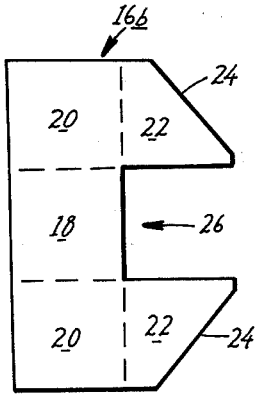

Both one-way and two-way notch blocks are formed from substantially rectangular pieces of wood or other suitable material, notched as shown in FIGS. 2*a* and 2*b*. Each of the blocks includes a throat 18, integrally formed with one or more bracing arms 20, each arm having a longitudinal extension 22 with an upwardly tapered forward edge 24 thereon. The space coadjacent the throat and bracing arm extension(s) 22 is defined as the gullet region 26.

As can be appreciated from FIG. 1, throat 18 of notch block 16 is slidably received within board end slot 14 and bracing arms 20 extend beyond one or both faces of the board to provide horizontal support for the stacked pipes.

The width of the throat region of the notch block is slightly less than the width of the board slot, allowing the slot throat to be slidingly received within the slot. The vertical dimension of the gullet region is slightly greater than the thickness of the board, allowing an end portion of the board to be slidingly received within the gullet region of a two-way slot block, as the block is moved inwardly along the board slot. The block is thus partially interlocked with the board in vertical and transverse directions.

Figure 3:
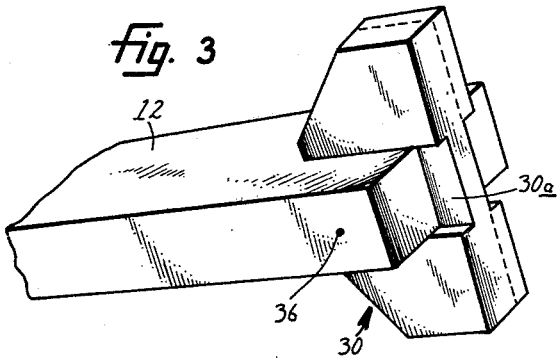
FIG. 3 is a perspective view similar to FIG. 1, showing a heavy duty block.

FIG. 3 shows a heavy duty block 30 designed to provide additional interlock between board and block. The heavy duty block, which may be a one-way or two-way block, differs from standard blocks 16*a* or 16*b* described above in that the sides of the blocks are grooved at 30*a*, such that the bracing arms have a greater thickness than the throat. As shown in FIG. 3, the portions of the bracing arm which extends transversely beyond the throat region overlap the faces of the board, providing additional interlock between board and block. Block 30 may be grooved on both sides, as shown, or on one side only, as indicated by the block formed between the visible grooved block face and the dotted line.

Figure 6:
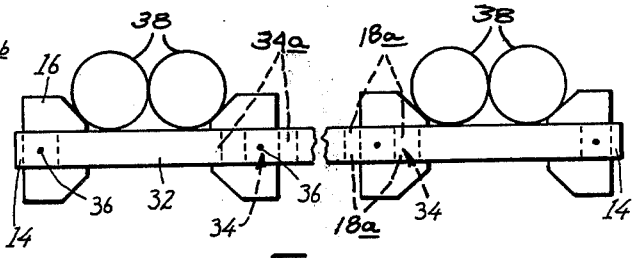
FIG. 6 is a foreshortened side view of an alternative embodiment of the invention having internal slots for receiving notch blocks therein.

Yet another embodiment of the invention is illustrated in FIG. 6. Here a longitudinal board 32 has a pair of end slots 14 and internal slots 34 for receiving blocks 16 therein. Internal slots 34 have transverse dimensions slightly greater than the width of the notch blocks to be received therein. The spacing between the edges 34*a* of the slots is slightly greater than the longitudinal dimension of bracing arms 20, which, in turn, is roughly twice the distance between the edges 18*a* of the block throat. This embodiment is particularly useful in stacking large pipes where it is advantageous to support individual or pairs of pipes from both sides.

The board used in practicing this invention is preferably a conventional lumber board having longitudinal slots 14*a* and 14*b* at its ends. Slot 14*a* has a length approximately equal to the longitudinal dimension of notch block throat 18 and is defined as the fixed end slot. Slot 14*b* has a length approximately twice that of the longitudinal dimension of throat 18 as is defined as the variable end slot.

Figure 4A:
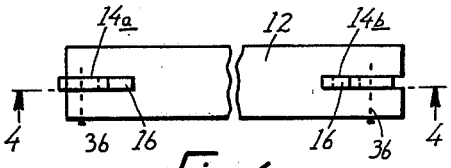
FIG. 4*a* is a foreshortened plan view of a preferred embodiment of the present invention.
Figure 4B:
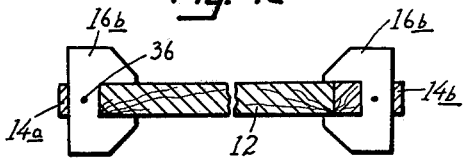
FIGS. 4*b* and 4*c* are cross-sectional views taken along line 4—4 of FIG. 4*a* showing pipe chocks having one-way and two-way blocks, respectively.
Figure 4C:
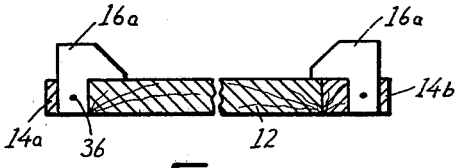

In stacking pipes, two or more such boards are initially preassembled by inserting one-way blocks 16*a* into fixed end slots 14*a*. The blocks are locked in the slots by driving a nail or other suitable fastener into the board against one or both faces of each block throat. Preferably, the blocks are so locked by a nail 36 which extends through the slot and throat region of the block, as shown in FIG. 4*a*.

Two or more such preassembled boards are then arranged in parallel, spaced apart fashion and a horizontal row of pipes, such as pipes 38, are placed on the boards. With the pipes arranged to abut the block at fixed end 14*a*, a one-way block is then inserted into each slot 14*b* until edge 24 of the block firmly abuts the adjacent pipe. This end block is then anchored longitudinally by similarly fastening the board transversely to the block throat. It can be appreciated that the variable slot 14*b* allows the notch block at the associated board end to be longitudinally positioned to abut the end pipe. This degree of longitudinal variation allowed by slot 14*b* is sufficient to accommodate small variations in pipe diameter normally present.

After the initial layer of pipes have been stacked, a second tier of pipes is then added, as shown in FIG. 5, by placing two or more parallel chock sticks on top of the first row of pipes. The second tier chock sticks are partially preassembled, analogous to the first tier of pipe chocks, by initially securing a two-way block to the fixed position end 14*a* of the board. After the second tier of pipes has been added, a two-way notch block is then inserted into each slot 14*b* and nailed therein so that the blocks at opposite ends of each board firmly abut the stacked pipes. Additional layers of pipe can be added similarly.

In the embodiment of FIG. 6, the two end slots are preferably fixed position slots, each having a longitudinal dimension approximately equal to the longitudinal dimension of throats 18. Internal slots 34, which have a longitudinal dimension roughly twice that of the block throats, are variable position slots. In use, the chock stick of FIG. 6 is partially preassembled by initially securing a one-way or two-way block in the board end slots and stacking the pipes on the board. A block 16*b* is then inserted to an associated intermediate slot 34, vertically aligned therein, as shown in FIG. 6, slidably moved in a longitudinal direction to produce a desired spacing between an end block and an associated intermediate block and secured at such position by a nail 36, as described above. It can be appreciated that the extent of the sliding adjustment permitted each block 16*b* within slot 34 is slightly less than the longitudinal dimension of the block gullet region, shown at 26 in FIG. 2*b*.

Thus, a pipe chock stick for stacking pipe or the like which is easily assembled, sturdy and which has interchangeable, reusable pieces, has been shown. Although specific embodiments of the invention have been shown and described, it will be obvious to those skilled in the art that various modifications may be made without departing from the spirit of the invention. In particular, the width of the board slots and the notch blocks, the longitudinal dimensions of the slots and the block throats, and the dimensions of the board may be varied according to the application.

It is claimed and desired to secure by letters patent:

1. A pipe chock stick used in bracing pipes or the like comprising an elongate board having a pair of opposed end regions and a pair of spaced-apart, substantially parallel faces, brace means securable to one of said end regions for bracing pipes stacked against said faces, means defining, intermediate said end regions, a longitudinally extending slot communicating with said faces, a block having a pair of opposed arms, portions of which define opposed, longitudinally extending edges of a gullet formed centrally in said block, said block being dimensioned to be received within said slot, by insertion of one of said arms therethrough, wherein said arms extend beyond associated ones of said faces, and said gullet being dimensioned to receive slidably therein, portions of said board adjacent and extending longitudinally of said slot, wherein the longitudinal position of said block within said slot may be selectively varied, and means for securing said block in said slot at a selected longitudinal position, wherein said block and said brace means, when the latter is secured to said board, are spaced apart a selected distance for bracing therebetween pipes stacked against said faces.

2. The stick of claim 1, wherein said securing means includes a nail driven through said board into said block, when the latter is positioned within said slot.

* * * * *